United States Patent [19]

Martinez, Jr.

[11] Patent Number: 5,022,231

[45] Date of Patent: Jun. 11, 1991

[54] PUMP OPTIMIZATION

[76] Inventor: George Martinez, Jr., P.O. Box 1141, Gonzales, La. 70737

[21] Appl. No.: 484,541

[22] Filed: Feb. 26, 1990

[51] Int. Cl.[5] ..... F25D 17/02

[52] U.S. Cl. ..... 62/99; 62/201; 237/63; 417/216

[58] Field of Search ..... 62/99, 201, 185; 237/63, 8 A; 417/216, 287

[56] References Cited

U.S. PATENT DOCUMENTS 3,036,779 5/1962 Hansen ..... 237/63

4,817,395 4/1989 Martinez, Jr. ..... 62/201 X

*Primary Examiner*—William E. Wayner

*Attorney, Agent, or Firm*—David L. Ray

[57] ABSTRACT

A method and apparatus for saving energy in a chilled water air conditioning system employing secondary pumping for supply chilled water and primary pumping for return chilled water wherein the primary pumping is eliminated comprising directing all of said supply chilled water to the secondary pumps and eliminating any flow of return chilled water through the secondary pumps.

2 Claims, 2 Drawing Sheets

PUMP OPTIMIZATION

BACKGROUND OF THE INVENTION

1. Field of the Invention

The present invention relates to a refrigeration and air conditioning system. In particular, the invention relates to a method and apparatus for saving energy in the operation of a large building employing chilled water air conditioning systems.

2. Description of the Related Art

In large buildings, air conditioning systems are designed to promote year-round cooling. This characteristic is essential to a cooling system designed for buildings in which the outer peripheral surfaces and areas are subject to wide temperature gradients while the inner portions remain relatively stable regardless of the ambient conditions.

Such an air conditioning system must, in general, be operated during substantially the entire year to provide the necessary cooling and air circulation. In the winter, the rooms on the outer periphery of the building must be heated and the interior rooms having no external exposure must be cooled. In the summer, the entire building must be cooled.

Since chilled water air conditioning systems in large buildings are commonly operated year round, to save energy, it is important that all elements of the chilled water air conditioning system be operated in the most efficient manner.

SUMMARY OF THE INVENTION

In accordance with the present invention there is provided a method and apparatus for saving energy in a chilled water air conditioning system employing secondary pumping for supply chilled water and primary pumping for return chilled water wherein the primary pumping is eliminated comprising directing all of said supply chilled water to the secondary pumps and eliminating any flow of return chilled water through the secondary pumps.

DESCRIPTION OF THE PREFERRED EMBODIMENTS

Figure 1:
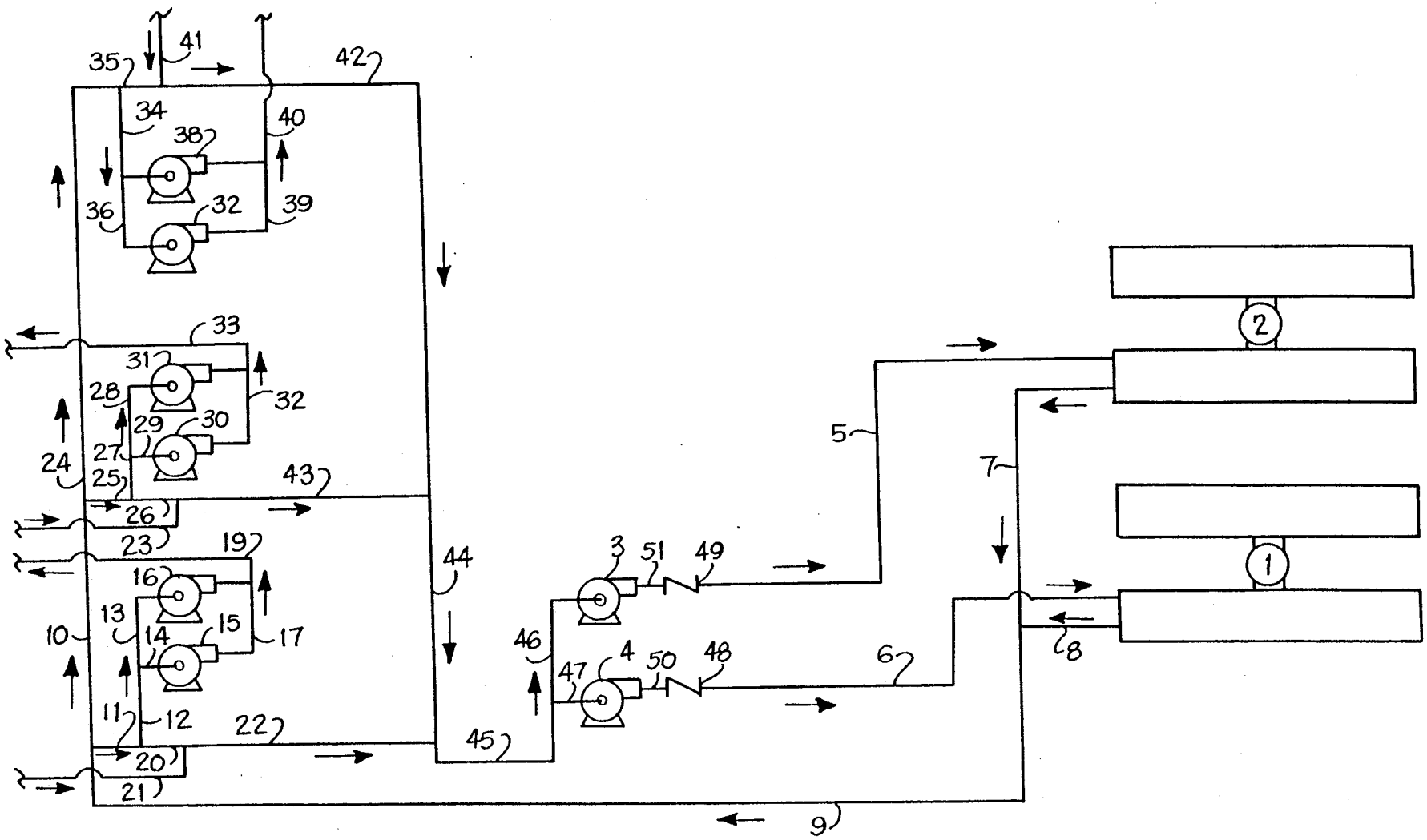
FIG. 1 is a schematic drawing of a conventional secondary and secondary pumping system of the prior art.

Referring now to the drawings, and in particular to FIG. 1, there is shown a conventional prior art secondary and primary pumping arrangement in a chilled water air conditioning system. Two chilled water air conditioners are generally indicated by the numbers 1 and 2, and are referred to herein as chillers 1 and 2. Two primary chilled water pumps are generally indicated by the numerals 3 and 4, and six secondary supply chilled water pumps are generally indicated by the numerals 15, 16, 30, 31, 37, and 38.

Chilled water exits chiller 1 through pipe 8 and chiller 2 through pipe 7 as indicated by the arrows adjacent to pipes 7 and 8. The water entering pipes 7 and 8 has been cooled by chillers 1 and 2 typically to a temperature of about 45 degrees fahrenheit, and is referred to herein as supply chilled water because it is supplied to those locations in the building requiring cooling.

Supply chilled water from pipes 7 and 8 enter pipe 9 and flows on to pipes 10, 24, and 35. Supply chilled water flows from pipe 10 to pipe 11, from pipe 11 to pipe 12, from pipe 12 to pipes 13 and 14, and from pipes 13 and 14 to secondary pumps 15 and 16, respectively.

Secondary pumps 14 and 16 discharge supply chilled water into pipe 17 and from pipe 17 into pipe 19. From pipe 19 supply chilled water flows to the locations in the building requiring cooling. Cooling is accomplished by flowing the supply chilled water through heat exchangers known in the art as air handlers (not shown) which are located in areas of the building requiring cooling. After the supply chilled water from pipe 19 flows through the air handlers, it returns through pipe 21 to pipe 20 and 22.

After the supply chilled water flows through the air handlers it is then referred to as return chilled water because it is being returned to chillers 1 or 2 to be cooled. Return chilled water typically has a temperature of of about 55 degrees fahrenheit.

Supply chilled water flows from pipe 10 to pipe 24 and pipe 25, from pipe 25 to pipe 27, from pipe 27 to pipes 28 and 29, and from pipes 28 and 29 to secondary pumps 30 and 31, respectively.

Secondary pumps 30 and 31 discharge supply chilled water into pipe 32 and from pipe 32 into pipe 33. From pipe 33 supply chilled water flows to the locations in the building requiring cooling. Cooling is accomplished by flowing the supply chilled water through heat exchangers known in the art as air handlers (not shown) which are located in areas of the building requiring cooling. After the supply chilled water from pipe 33 flows through the air handlers, it returns through pipe 23 to pipe 26 and 43.

Supply chilled water flows from pipe 24 to pipe 34 and pipe 35, from pipe 34 to pipe 36, pipe 36 to secondary pumps 37 and 38.

Secondary pumps 37 and 38 discharge supply chilled water into pipe 39 and from pipe 39 into pipe 40. From pipe 40 supply chilled water flows to the locations in the building requiring cooling. Cooling is accomplished by flowing the supply chilled water through heat exchangers known in the art as air handlers (not shown) which are located in areas of the building requiring cooling. After the supply chilled water from pipe 40 flows through the air handlers, it returns through pipe 41 to pipe 35 and 42.

Return chilled water from pipes 42, 43, 44 and 22 enters pipe 45 and flows to pipes 46 and 47. Return chilled water flows from pipes 46 and 47 to primary pumps 3 and 4, respectively.

Primary pumps 3 and 4 discharge return chilled water pipes 51 and 50, through check valves 49 and 48 into return chilled water pipes 5 and 6. From return chilled water pipes 5 and 6 chilled water is returned to chillers 2 and 1, respectively.

In the prior art system shown in FIG. 1, supply chilled water is blended with return chilled water at the junction of pipes 11 and 20, at the junction of pipes 25 and 26, and at the junction of pipes 34 and 35. Blending of supply chilled water with return chilled water at the junctions results in a waste of energy since some of the return chilled water enters the secondary pumps and is pumped back to the air handlers (not shown) without going through the chillers 1 or 2.

Figure 2:
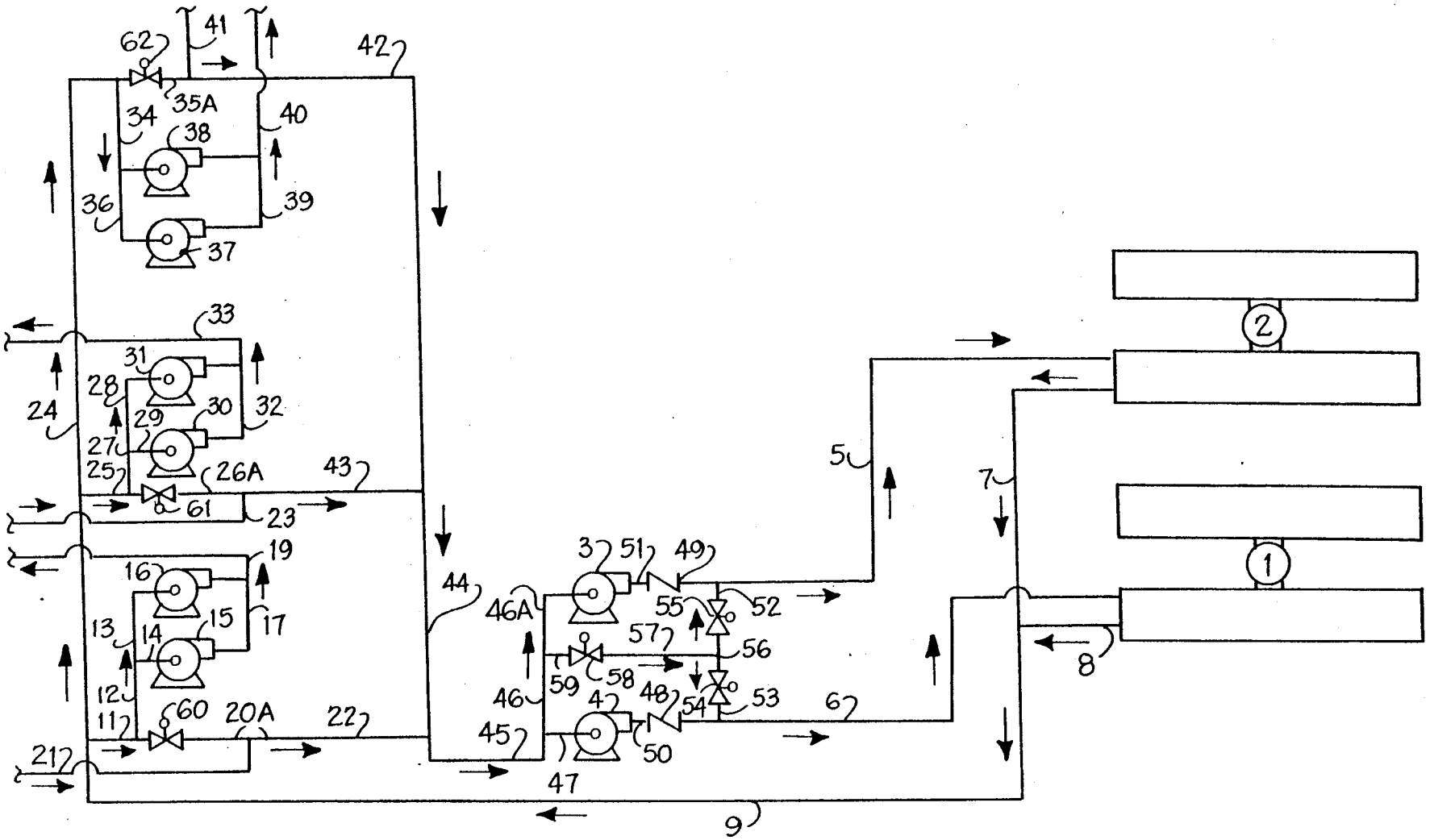
FIG. 2 is a schematic drawing of the present invention for eliminating primary pumping.

In accordance with the invention shown in FIG. 2, blending of supply chilled water with return chilled water is eliminated and energy is saved. Furthermore, the primary pumps 3 and 4 are eliminated and additional energy is saved.

Referring now to FIG. 2, supply chilled water flow and return chilled water flow is the same as in FIG. 1 with the following exceptions:

Valves 60, 61, and 62 are connected to pipes 20A, 26A, and 35A. Valves 60, 61, and 62 are closed when chillers 1 and 2 are operating to route all supply chilled water through the secondary pumps 15, 16, 30, 31, 37, and 38, thus eliminating the blending of supply chilled water with return chilled water which occurred in the system of the prior art described in FIG. 1.

Furthermore, new pipe 59 is connected to pipe 46 to flow return chilled water around primary pumps 3 and 4. Return chilled water flows from pipe 59 through valve 58 to pipe 57, from pipe 57 to pipe 56, from pipe 56 to valves 54 and 55, from valve 55 to pipe 52 to pipe 5, and from valve 54 to pipe 53 to pipe 6.

Thus, the need for primary pumps 3 and 4 is eliminated and the pumps can be turned off, thereby saving part of the energy formerly consumed by the primary pumps.

It is believed that the invention and many of its attendant advantages will be understood from the foregoing description and it will be apparent that various changes may be made in the form, construction, and arrangement of the parts without departing from the spirit and scope of the invention. The form hereinbefore described are merely preferred embodiments of the invention.

What is claimed is:

1. In a chilled water air conditioning system employing secondary pumping for supplying chilled water from the air conditioning unit to the areas requiring cooling and primary pumping for returning said chilled water to said air conditioning unit, the improvement comprising:

a. directing the entire amount of water chilled by said air conditioning unit to said secondary pumps, b. pumping all of said water chilled by said air conditioning unit through said secondary pumps, c. directing said entire amount of said water chilled by said air conditioning unit around said primary pumps to said air conditioning unit.

2. A method for saving energy in a chilled water air conditioning system employing secondary pumps for supply chilled water and primary pumps for return chilled water, comprising:

a. directing all of said supply chilled water to said secondary pumps, b. pumping all of said supply chilled water through said secondary pumps, c. turning said primary pumps off, and d. by-passing said return chilled water around said primary pumps.

* * * * *